United States Patent [19]

Weber

[11] 4,022,376

[45] May 10, 1977

[54] DIGITAL DISPLAY MECHANISM

[75] Inventor: Richard H. Weber, Indianapolis, Ind.

[73] Assignee: P. R. Mallory & Co., Inc., Indianapolis, Ind.

[22] Filed: Sept. 17, 1975

[21] Appl. No.: 614,105

Related U.S. Application Data

[62] Division of Ser. No. 449,696, March 11, 1974, Pat. No. 3,922,848.

[52] U.S. Cl. ..... 235/134; 58/126 E

[51] Int. Cl.[2] ..... G06C 7/10

[58] Field of Search ..... 235/117 R, 134, 135, 235/141, 109, 136, 133; 40/77.4, 77.8; 58/125 R, 125 C, 126 E

[56] References Cited

UNITED STATES PATENTS

| | | | |
|---|---|---|---|
| 2,351,814 | 6/1944 | Holzner | 235/117 R X |
| 2,576,119 | 11/1951 | Holzner | 58/125 C X |
| 2,762,190 | 9/1956 | Holzner | 58/125 C X |
| 3,279,166 | 10/1966 | Funaki | 58/125 C |
| 3,328,954 | 7/1967 | Miller | 235/109 X |
| 3,831,303 | 8/1974 | Funaki | 58/125 C X |
| 3,910,032 | 10/1975 | Funaki et al. | 58/125 C |

*Primary Examiner*—Ulysses Weldon
*Attorney, Agent, or Firm*—Hoffmann, Meyer & Coles

[57] ABSTRACT

A first rotating display means having indicia on its outer periphery, rotates within and in synchronization with a second rotating display means having indicia and a window on its outer periphery, the indicia for the first display means being visible through the window at selected times.

4 Claims, 7 Drawing Figures

DIGITAL DISPLAY MECHANISM

This is a division of Application Ser. No. 449,696 filed 3-11-74 now U.S. Pat. No. 3,922,848.

Generally speaking, the present invention relates to digital display mechanism wherein rotatable display means carry idicia on their peripheries, the indicia being viewed through a window, the display mechanism being characterized by providing a first rotatable display means having at least one window and indicia spaced about its periphery, a second rotatable display means rotatable within the first rotatable display means and having indicia spaced about its outer periphery to be individually exposed to the window in the periphery of the first rotatable display means, and means synchronizing the rotation of one of the rotatable display means with respect to the other.

The digital display mechanism of the present invention is of the type used in digital clocks, automobile odometers, and digital counters. In these applications, the digit height is limited by the number of digits on each wheel and the wheel circumference. Such limitations become especially critical in digital clock application for range timers. More particularly, because of the severe space limitations in the backguard (control panel) of ranges it has been found to be difficult, if not impossible, to incorporate digital clocks into ranges of sufficient size to provide easily readable digit heights. Indeed, this is the principle reason why ranges normally employ conventional clocks having minute and hour hands. Such conventional clocks are, at best, difficult to read.

Accordingly, it is a feature of the present invention to provide a digital display mechanism having rotating display wheels with easily readable digits without an excessively large wheel diameter. Another feature of the invention is to provide a digital display mechanism having rotatable display means wherein one such rotatable display means rotates within another rotatable display means. Still another feature of the invention is to provide a digital display mechanism having a rotatable display mechanism rotating within another rotatable display mechanism and wherein there is a synchronizing means to synchronize the rotation of one of the rotatable display means with respect to the other. Yet still another feature of the invention is to provide a digital clock employing rotating display wheels wherein there is one display wheel rotating with another display wheel. Another feature of the invention is the provision of a digital clock mechanism wherein a single rotating wheel displays seconds; the minutes are displayed on two rotating wheels, one rotating within the other; the tens-of-minutes are displayed on a single, rotating wheel; and the hours are displayed on two rotating wheels, one rotating with the other; the digital clock further including means to synchronize the rotation of the wheelswith respect to each other. These and other features of the invention will become readily apparent from the following description taken in conjunction with the accompanying drawings wherein:

Figure 2:
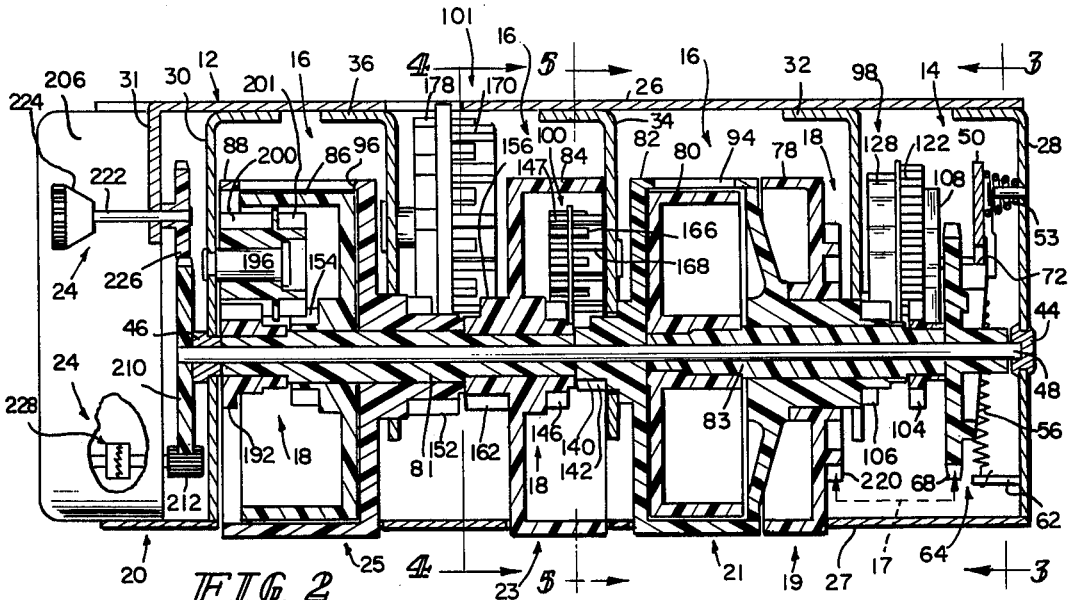
FIG. 2 is a section taken along the line 2—2 of FIG. 1.
Figure 2A:
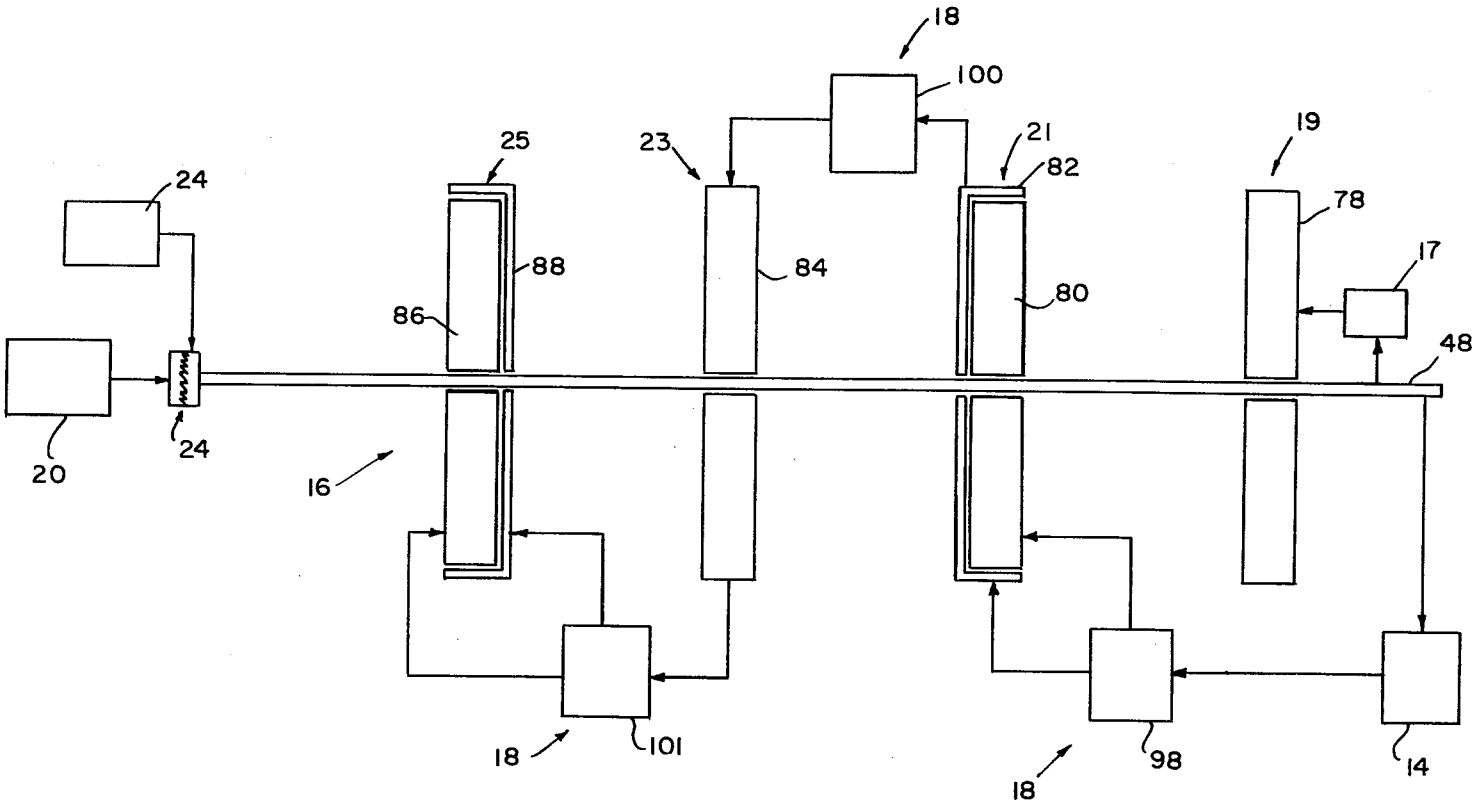

FIG. 2*a* is a schematic of the digital display mechanism.

Figure 3:
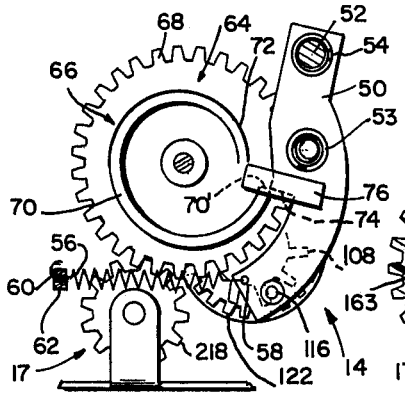
Figure 4:
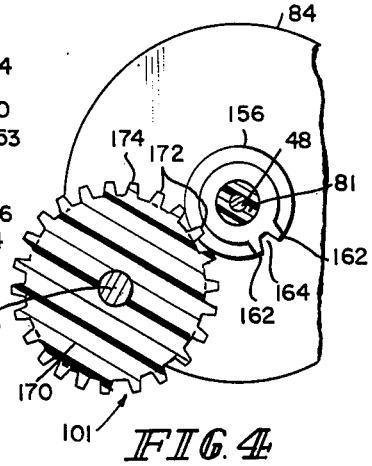
Figure 5:
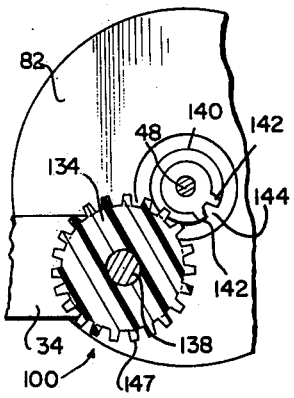
Figure 6:
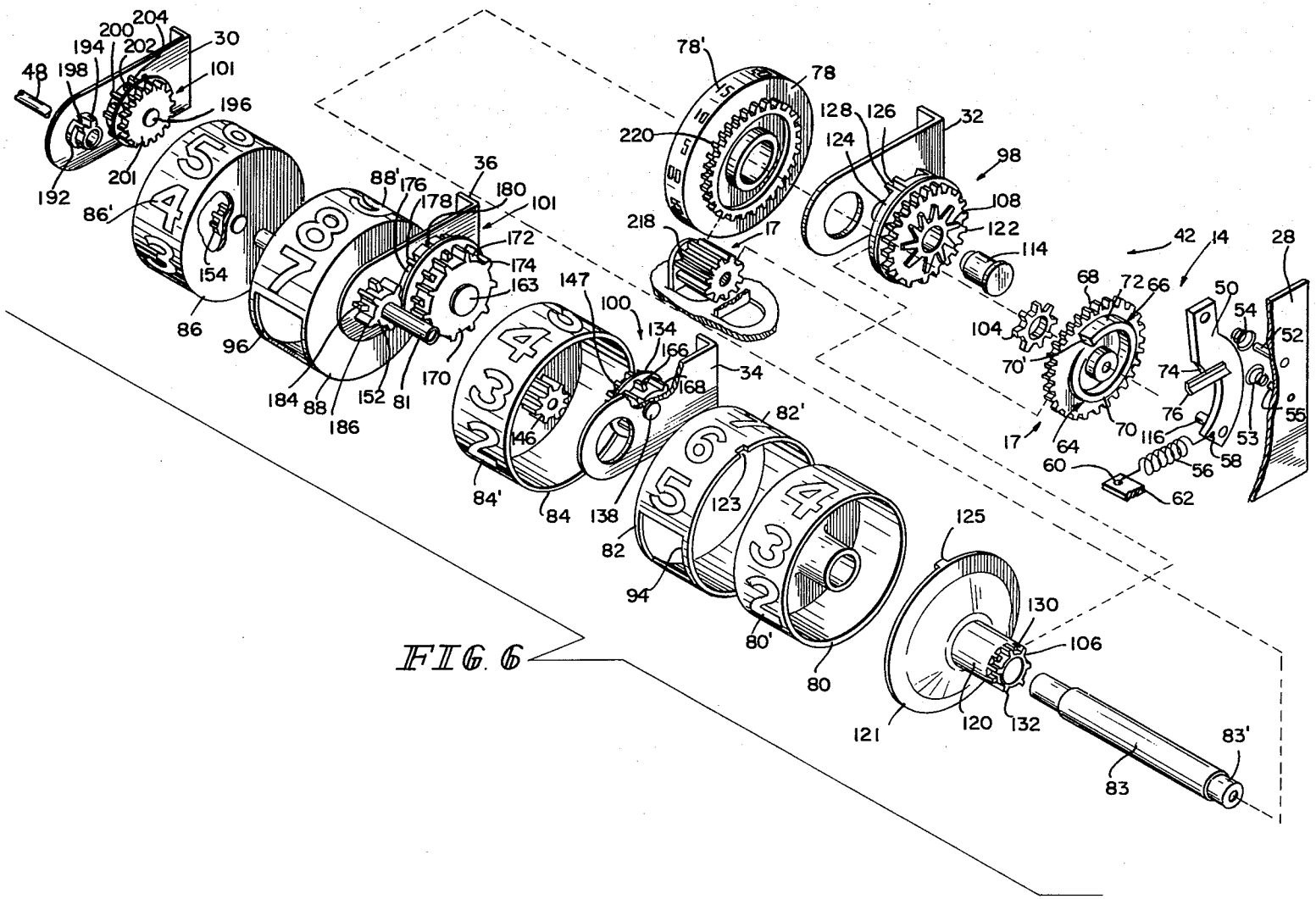

FIGS. 3–5 are sections taken along the line 3—3, 4—4 and 5—5 respectively of FIG. 2; and FIG. 6 is an exploded view of the display mechanism.

Figure 1:
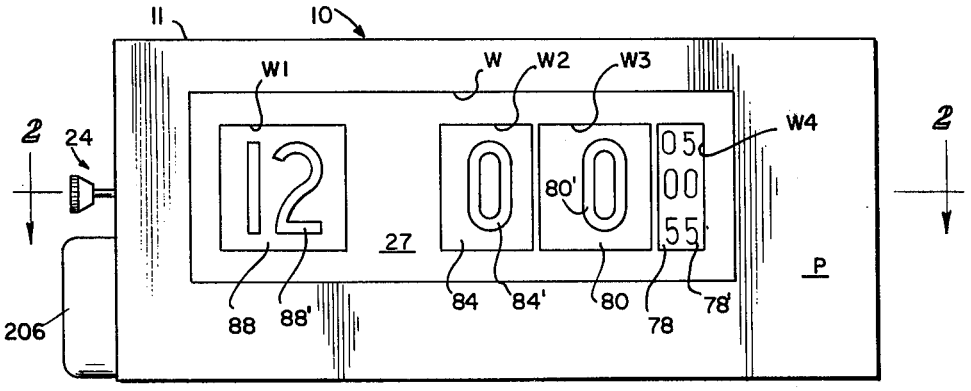
FIG. 1 is a front view of digital display mechanism embodying the principles of the invention.

With reference to FIG. 1, digital display mechanism 10 is illustrated as a digital clock carried in a case 11 having a front plate P and a display window W provided in the plate, the display window being divided into separate windows $W_1$, $W_2$, $W_3$ and $W_4$ for displaying hours, tens of minutes, minutes and seconds.

With particular reference to FIGS. 2 and 2*a*, digital display mechanism 10 generally housing means 12, intermittent advance means 14, rotatable display means 16, synchronizing means 18, drive means 20, and reset means 24. More specifically, with reference to FIG. 2*a*, rotatable display means 16 displays the time of day and includes a seconds display means 19, a minutes display means 21, a tens-of-minutes display means 23, and an hours display means 25. In the illustrative embodiment, seconds display means 19 and tens-of-minutes display means 23 include single wheels 78 and 84 rotatably carried on shaft 46. Minutes display means 21 and hours display means 25 each include a pair of wheels 80, 82 and 86, 88 respectively rotatably carried on shaft 48. There is a coupling means 17 connecting seconds wheel 78 directly to shaft 48 so as to be rotated at constant speed by drive means 20. As shown, the other display means are incrementally advanced through intermittent advance means 14 and synchronizing means 18. Synchronizing means 18 includes drive and synchronizing means 98, 100 and 101. The clock may be reset through manual reset means 24.

Housing means 12 includes front plate 27, a rear plate 26, bulkheads 28 and 30, and intermediate support members 32, 34 and 36, all of which are suitably attached to rear plate 26. Windows $W_1$ to $W_4$ are provided in front plate 27. Bushings 44 and 46 are carried respectively on bulkheads 28 and 30. Shaft 48 is rotatably-journaled in bushings 44 and 46.

In the illustrated embodiment, drive means 20 includes a permanent magnet synchronous motor 206, however other sources of constant-speed rotational motion may be used. Motor 206 is suitably connected between front plate 27 and rear plate 26 on motor bulkhead 31. Although not shown, the synchronous motor would include a gear train to reduce the output speed in a manner well known in the art.

Referring to FIGS. 1 and 2 drive means 20 further includes a gear 210 meshing with a motor output pinion 212. Gear 210 is fixedly carried near an end of central shaft 48. It should be noted that none of the components of rotatable display means 16 are connected to shaft 48. The display wheels 78, 80, 82, 84, 86 and 88 all rotate concentrically about shaft 48, but none are attached directly. Coupling means 17 provides a direct connection to shaft 48 for wheel 78 and includes a transfer pinion 218 (FIGS. 3 and 6) carried by housing means 12 which engages both a gear 68 carried on drive cam 64 and a gear 220 carried on second display wheel 78.

Manual reset means 24 is provided to permit manual setting of the clock. Reset means 24 includes a manually rotatable shaft 222 journaled in a motor bulkhead 31, gear 226, and clutch means 228. Shaft 222 is manually rotated through knob 224. Rotation of shaft 222 permits shaft 48 to be rotated independent of the motor through clutch 228 so as to reset the clock.

Referring to FIGS. 2, 3 and 6 intermittent advance means 14 includes a drive cam 64, a drive lever 50 and an actuator means 42. Drive lever 50 is pivotly carried on shaft 52. Shaft 52 is staked to bulkhead 28. A conical compression spring 54 is carried about shaft 52 and sandwiched between drive lever 50 and bulkhead 28. the location of spring 54 is such as to urge drive lever 50 along drive lever shaft 52 away from bulkhead 28. A helical tension spring 56 is connected one end to an aperture 58 in drive lever 50 and the other end to an aperture 60 in a tab 62 extending from bulkhead 28. The location of spring 56 is such as to urge lever 50 in a direction generally toward the longitudinal axis of central shaft 48.

Drive cam member 64 is carried by and rotatable with central shaft 48. Drive cam member 64 includes a cam profile 66 and gear 68. Cam profile 66 includes an axially-ramped surface 70 and a spiral surface 72 which are substantially normal to each other. Axially-ramped surface 70 includes a drop off 70'. A follower tip 74 carried on drive lever 50 engages spiral surface 72. A rise follower tab 76 is also carried on drive lever 50, the tab being biased against surface 70 through compression spring 53. Compression spring 53 is carried about post 55 which is staked to bulkhead 28. Spiral surface 72 causes drive lever 50 to pivot about drive lever 52; whereas ramped surface 70 causes drive lever 50 to move axially along shaft 52. Movement of drive lever 50 advances actuator means 42. Actuator means 42 advances drive and synchronizing means 98 (FIG. 2*a*) and includes a ratchet profile 108 and gear 122. More particularly, as shown in FIG. 6, a drive pin 116 engages ratchet profile 108, which in turn rotates gear 122. Gear 122 and ratchet profile 108 are rotatable about post 114 which is staked onto intermediate support member 32.

With reference to FIGS. 1, 2, 2*a* and 6 as previously noted, rotatable display means 16 includes a seconds display wheel 78, an inner minutes-display wheel 80, an outer minutes display wheels 82, a tens-of-minutes display wheel 84, an inner hours display wheel 86, and an outer hours display wheel 88. The illustrated embodiment displays time of day digitally by displaying hours on wheels 86 and 88, tens-of-minutes on wheel 84, minutes on wheels 80 and 82, and seconds on wheel 78. It should be understood that different formats of display such as hours, tens-of-hours, and hundreths-of-hours can be used. Indicia 78',80',82',84',86'and 88' are carried on the peripheries of their respective display wheels. In the illustrated embodiment, one example of a set of indicia is shown. Again it should be understood that many different styles and formats of the indicia may be used.

Indicia 78' on the periphery of seconds display wheel 78 include the printed numbers 0, 5, 10, 15, 20, 25, 30, 35, 40, 45, 50 and 55 sequentially displayed through window $W_4$. The printed numbers are angularly spaced about 30° apart around the entire periphery of seconds display wheel 78. The seconds display wheel rotates about central shaft 48.

Indicia 80' on the periphery of minutes display wheel 80 include the printed numbers 0, 1, 2, 3 and 4 sequentially displayed in this order. The printed numbers are angularly spaced about 72° apart around the entire periphery of wheel 80. Indicia 82' on the periphery of minutes display wheel 82 include the printed numbers 5, 6, 7, 8 and 9, sequentially appearing as recited. The vertical height of these numbers as one would read them is substantially the same as that of the numbers appearing on inner minutes display wheel 80. A minutes wheel window 94 is also located on the periphery of wheel 82 between numbers 9 and 5. The shape of window 94 is generally rectangular and of a size slightly larger than numbers on wheels 80 and 82. The window and numbers 5, 6, 7, 8 and 9 are spaced about 60° apart around the periphery of wheel 82. The numbers on the outer wheel 82 may be viewed through window $W_3$. Inner minutes display wheel 80 rotates concentrically about shaft 48 on sleeve 83 within outer minutes display wheel 82. The numbers on the outer periphery of the inner wheel 80 may be viewed through window 94 in outer wheel 82 and thus through window $W_3$.

Indicia 84' on the periphery of tens-of-minutes display wheel 84 include the printed numbers 0, 1, 2, 3, 4 and 5. The printed numbers are of a vertical height generally the same as the height of numbers on minute wheels 80 and 82 and are angularly spaced about 60° apart around the entire periphery of wheel 84. They may be viewed through window $W_2$. Wheel 84 rotates concentrically with wheels 78, 80 and 82 about central shaft 48.

Indicia 86' on the periphery of inner hours display wheel 86 include the printed number 1, 2, 3, 4, 5 and 6. the printed numbers are angularly spaced about 60° apart around the entire periphery of wheel 86. Indicia 88' on the periphery of outer hours display wheel 88 include the printed numbers 7, 8, 9, 10, 11 and 12 sequentially appearing in this order. The numbers on wheels 86 and 88 are of a vertical height substantially the same as the height of numbers on minutes wheels 80 and 82 and tens-of-minutes wheel 84. An hours window 96 is also located in the periphery of outer hours display wheel 88 between the numbers 7 and 12. Window 96 is substantially rectangular-shaped and of a size slightly larger than numbers on wheels 86 and 88. Window 96 and numbers 7, 8, 9, 10, 11 and 12 are spaced about 51.4° apart around the periphery of wheel 88. Both the outer hours display wheel and the inner hours display wheel rotates about central shaft 48. The numbers on the periphery of inner wheel 86 may be viewed through window 96 in outer wheel 88 such that both sets of indicia 86' and 88' are viewed through window W.

Referring to FIGS. 2, 2*a* and 4–6, synchronizing means 18 includes a minutes drive and synchronizing means 98, tens-of-minutes drive and synchronizing means 100, and an hours drive and synchronizing means 101. As will become apparent, such drive and synchronizing means drive the display wheels and insure that the numbers will be properly correlated even in the case where one display wheel is rotating within another.

Drive and synchronizing means 98 drives outer and inner minutes wheels 80 and 82 and synchronizes their rotation with respect to each other and includes locking ring 124, driveprojections 128, an inner wheel pinion 104, and an outer wheel pinion 106. Inner wheel pinion 104 is carried on an end 83' of sleeve 83 which also carries inner minutes display wheel 80. Locking ring 124 is carried or other wise connected to gear 122. Drive projections 128 extend from a face of the locking ring near its outer periphery and are equally spaced apart angularly and, in the illustrated embodiment, are spaced about 18° apart forming a group of 12 projections, (or six pairs) occupying an angle of about 198° to provide six equally spaced notches 126 therebetween. Projections 128 engage outer wheel pinion 106 which is carried by a hub 120 of a drive disc 121. Drive disc 121 engages outer minutes display wheel 82 through the cooperation of notch 123 and tab 125. As particularly shown in FIG. 6, outer wheel pinion 106 includes an even number of gear teeth. The face width of every other tooth is about half that of the remaining teeth so that short teeth 130 are regularly interspersed between long teeth 132. Both long and short teeth are engaged by projections 128 carried on locking ring 124. However, only the long teeth 132 are capable of contacting locking ring 124 wheel; the short teeth 130 do not. The advancement of ratchet profile 108 rotates gear 122 and locking ring 124, the rotation of gear 122 causing rotation of pinion 104 and thus inner minutes display wheel 80. When long teeth 132 engage locking ring 124, rotation of outer wheel pinion 106 and drive disc 121 are prevented and thus rotation of outer minutes display wheel 82 is prevented. When a projection 128 engages a short tooth 130, drive disc 121 advances as does outer minutes display wheel 82, a long tooth 132 having engaged a notch 126 located between two adjoining projections 128. Thus, inner and outer wheels 80 and 82 are synchronized with respect to each other.

Referring to FIGS. 2, 5 and 6, tens-of-minutes drive and synchronizing means 100 synchronizes the rotation of tens-of-minutes wheel 84 to outer minutes display wheel 82. It includes an idler gear 134, gear 146, locking ring 140 and drive projections 142. Idler gear 134 is rotatably mounted on a post 138 staked to intermediate support member 34 in such a manner as to be rotatable within the interior of tens-of-minutes display wheel 84. Gear 146 is carried on the inside of wheel 84, wheel 84 being rotatable about a sleeve 81. Locking ring 140 extends from outer minutes display wheel 82 toward tens-of-minutes display wheel 84. Drive projections 142 extend from the periphery of locking ring 140 to provide a notch 144 therebetween. One face of idler gear 134 has an even number of gear teeth, the face width of every other one being shorter than the remaining teeth so that short teeth 166 are regularly interspersed between long teeth 168. Both long and short teeth are engaged by projections 142. However, only the long teeth are capable of contacting locking ring 140. The other face of gear 134 includes teeth 147 engaging gear 146 carried by tens-of-minutes display wheel 84. Locking ring 140 rotates in accordance with the rotation of outer minutes display wheel 82. Gear 134 will not rotate so long as the long teeth 168 engage the periphery of locking ring 140. When a projection 142 engages a short tooth 166, gear 134 is advanced, a long tooth 168 having engaged notch 144. Advancement of gear 134 advances tens-of-minutes display wheel 84 through teeth 147 engaging gear 146. Thus, tens-of-minutes display wheel 84 is synchronized with respect to outer minutes display wheel 82.

Referring to FIGS. 2, 4 and 6, hours drive and synchronizing means 101 synchronizes tens-of-minutes wheel 84 with both inner hours display wheel 86 and outer hours display wheel 88 and includes gear 170, gears 200 and 201, and outer-wheel pinion 152, an inner wheel pinion 154, locking ring 156, drive projections 162, locking ring 176, drive projections 178, locking ring 192 and drive projections 194. Locking ring 156 is carried by tens-of-minutes display wheel 84. Protruding from the periphery of locking ring 156 are two drive projections 162 providing a notch 164 therebetween. Gear 170 is rotatably carried on post 163 which is staked to intermediate support member 36. Gear 170 has an even number of teeth, the face width of every other one being shorter than the remaining teeth so that short teeth 172 are regularly interspersed between long teeth 174. Both long and short teeth are engaged by projections 162. However, only the long teeth are capable of contacting locking ring 156. Locking ring 176 is carried on gear 170 and has drive projections 178 protruding therefrom . Drive projections 178, in the illustrated embodiment, are spaced about 15° apart forming a group of 14 projections occupying an angle of about 210°. Disposed between two adjacent projections 178 is a notch 180, there being seven of such notches. Projections 178 engage outer wheel pinion 152 which is carried by and generally concentric with outer hours display wheel 88. Outer wheel pinion 152 has an even number of gear teeth. The face width of every other tooth is about half the remainig teeth so that short teeth 184 are interspersed between long teeth 186. Both long and short teeth are engaged by drive projections 178. However, only the long teeth 186 are capable of contacting locking ring 176. Locking ring 192 is carried by sleeve 81 and has disposed thereon a set of drive projections 194 providing a notch 198 therebetween. Gears 200 and 201 are connected together and are rotatably carried on post 196 which is staked to bulkhead 30. Gear 200 includes an even number of gear teeth, the face width of every other one being shorter than the remaining teeth so that short teeth 202 are regularly interspersed between long teeth 204. Both long and short teeth are engaged by drive projections 194. However, only the long teeth are capable of contacting locking ring 192. Rotation of gear 200 engages inner wheel pinion 154 carried by inner hours display wheel 86 through gear 201.

In the operation of synchronizing means 101, locking ring 156 rotates in accordance with the rotation of tens-of-minutes wheel 84. Gear 170 will not rotate so long as long teeth 174 engage the periphery of locking ring 156. When a projection 162 engages a short tooth 172, gear 170 is advanced, a long tooth 174 engaging a notch 164. Advancement of gear 170 rotates locking ring 176. Outer wheel pinion 152 will not rotate so long as long teeth 186 of the outer wheel pinion engages locking ring 176. Thus outer hours display wheel 88 will not advance. When a projection 178 engages a short tooth 184, pinion 152 will advance, a long tooth 186 having engaged a notch 180. Advancement of pinion 152 advance outer hours display wheel 88. Thus the outer hours display wheel 88 is synchronized with respect to tens-of-minutes wheel 84.

Further, in the operation of drive and synchronizing means 101, locking ring 192 rotates in accordance with tens-of-minutes wheel 84 through sleeve 81. Gear 200 will not rotate so long as long teeth 204 engage the periphery of locking ring 192. When short teeth 202 engages drive projections 194, gear 200 and thus gear 201 advances, a long tooth 204 having engaged a notch 196. Inner wheel pinion 154 will then rotate through gear teeth 201 so as to rotate or advance inner hours display wheel 86. Thus the inner hours display wheel is also synchronized with respect to tens-of-minutes wheel 84.

CLOCK OPERATION

Referring again to FIG. 2*a*, the operation of the digital clock can generally be described. Drive means 20 rotates shaft 48. Seconds wheel 78 rotates at a constant speed in accordance with the rotation of the shaft through coupling means 17. Intermittent drive means 14 is incrementally advanced to rotationally and incrementally advance drive and synchronizing means 98.

Drive and synchronizing means 98 advances both the minutes wheels 80 and 82, each of their advancements being synchronized with respect to each other. Advancement of wheel 82 advances tens-of-minutes wheel 84 through drive and synchronizing means 100, advancement of wheel 84 in turn advancing hours wheels 86 and 88 through drive and synchronous means 101.

It is possible to begin this complete chain of events without intermittent advane means 14. That is, drive and synchronous means 98 could be connected directly to shaft 48. However, the use of the intermittent drive means 14 provides for a quick "snap-acting" advancement of all of the drive and synchronizing means such that there will be substantially no delay of the advancement of the display means.

With reference to FIGS. 1, 2 and 6, the clock operation can now be described in greater detail. Permanent magnet synchronous motor 206 is energized by an alternating-current power source (not shown) and motor output pinion 212 rotates. This rotational motion is translated through gear 210 to thereby rotate central shaft 48. Drive cam member 64, being coupled to shaft 48, also rotates. Gear 68 on cam 64 drives transfer pinion 218. Pinion 218 drives gear 220 on seconds display wheel 78, causing wheel 78 to rotate at one revolution per minute.

Drive cam member 64 rotates at one revolution per minute. During the period of one complete revolution of drive cam member 64, the following motions occur in the order recited:

1. Ramped surface 70 acts against follower tab 76 to urge drive lever 50 along drive lever shaft 52 against the compressive force of conical compression spring 54;

2. Drive pin 116 on lever 50 moves out of engagement with ratchet profile 108;

3. Sprial surface 72, acting against follower tip 74, causes lever 50 to pivot a predetermined angle about shaft 52 against the tension of helical spring 56;

4. Ramped surface 70 allows lever 50 to move back along shaft 52 away from spring 54;

5. Drive pin 116 re-engages ratchet profile 108 one tooth space away from where it previously moved out of engagement;

6. Follower tip 74 quickly (less than 2 seconds in the illustrated embodiment) drops off spiral surface 72 causing lever 50 to pivot a predetermined angle;

7. Dirve pin 116 drives a tooth of ratchet profile 108 thereby incrementally advancing gear 122 and drive projections 128 through an angle of about 36°; and

8. Gear 122 drives pinion 104, which causes inner minutes display wheel 80, on which pinion 104 is carried, to incrementally advance through an angle of about 72°.

The motions described above occur about once every minute during the operation of digital display mechanism 10. For about 58 seconds out of every minute wheel 80 remains stationary, then takes; about two seconds to rotate about 72° to the next position.

Drive projections 128 engage outer wheel pinion 106 only during a portion of a complete revolution of gear 122. When in engagement, projections 128 drive outer minutes display wheel 82 through first outer wheel pinion 106 an angle of about 60° upon each incremental advance of wheel 102. When not in engagement, locking ring 124 contacts the sides of two adjacent long teeth 132 on outer wheel pinion 106, thereby preventing pinion 106 and outer minutes display wheel 82 from advancing. The arrangement of projections 128 and locking ring 124 is such as to provide an incremental advance of outer wheel 82 during each of six consecutive incremental advances of gear 122. And, during the next following four consecutive incremental advances, wheel 82 dwells in one position. This pattern repeats after every ten incremental advances of gear 122 as described above.

During the dwell of outer minutes display wheel 82, window 94 on the periphery of outer wheel 82 aligns with viewing window $W_3$ in front plate 27 so that printed numbers displayed on the periphery of inner wheel 80 can be viewed through the windows. During the dwell, inner wheel 80 incremental advances to display printed numbers 0, 1, 2, 3, and 4 consecutively. Upon advancing from 4 to 0, outer wheel 82 advances to display the printed number 5 on its periphery through viewing window $W_3$. Although inner wheel 80 has advanced so that number 0 aligns with window $W_3$, it cannot be viewed now that window 94 has rotated out of alignment with window $W_3$. On the next advance, outer wheel 82 moves to display the printed number 6 through window $W_3$, and, at the same time, the inner wheel 80 advances to align the number 1 with window $W_3$ although the number cannot be seen because window 94 is no longer aligned with window $W_3$. On the subsequent advance, outer wheel 82 moves to display the printed number 2 through window $W_3$, and at the same time, inner wheel 80 advances to align the number 3 (still hidden) with window $W_3$. On the following advance, outer wheel 82 moves to display the printed number 9 through window $W_3$, and inner wheel 80 advances to align the number 4 (still hidden) with window $W_3$. On the next advance, the cycle starts to repeat itself as outer wheel 82 moves to align its window 94 with window $W_3$, and inner wheel 80 advances to display the number 0 through both windows. The cycle described above repeats itself every 10 advances of gear 122.

At the same time, and only then, inner minutes display wheel 80 advances from a position for which the number 9 is displayed through window $W_3$ to a position where the number 0 is displayed, the second set of projections 142 carried by outer minutes display wheel 80 engage idler gear 134 and drives it part of a revolution. Gear 134, in turn, engages gear 146 through teeth 147 carried by tens-of-minutes display wheel 84 and causes that wheel to rotate through an angle of about 60°. Each time wheel 84 advances, one of the numbers on the outer periphery of wheel 84 can be viewed through second viewing window $W_2$.

Upon advancing of wheel 84 from a position where the number 5 appears in window $W_2$ to a position where the number 0 appears, a third set of drive projections 162 engages gear 170. During the time that wheel 84 is not advancing from the 5 position to the 0 position, locking ring 156 on wheel 84 engages the sides of two adjacent long teeth 174 and prevents gear 170 from rotating. Since drive projections 178 only appear around a portion of locking ring 176, they can engage outer wheel pinion 152 only during a portion of a complete revolution of gear 170. When in engagement, projections 178 can drive hours display wheel 88 through wheel pinion 152 an angle of about 51.4° upon each incremental advance of gear 170. When not in engagement, locking ring 176 contacts the sides of two adjacent long teeth 186 on outer pinion 152, thereby preventing pinion 152 and outer hours display wheel 82 from moving. The arrangement of projections 178 and locking ring 176 is such as to provide an incremental advance of hours wheel 88 during each of seven consecutive incremental advances of gear 170. And during the next following five incremental advances of gear 170, wheel 88 dwells in one position. This pattern repeats after every 12 incremental advances of gear 170 as described above.

Upon advancing tens-of-minutes display wheel 84 from a position where the number 5 appears in window $W_2$ to a position where the number 0 appears, drive projections 194 engage idler gear 200. During the time that wheel 84 is not advancing from the 5 position to the 0 position (as viewed through window $W_2$) locking ring 192 engages the sides of two adjacent long teeth 204 and prevents idler gear 200 from rotating. Idler gear 201 directly engages second inner wheel pinion 154 carried by inner hours display wheel 86 so that each time tens-of-minutes display wheel 84 incrementally advances from the 5 position to the 0 position, inner hours wheel 86 incrementally advances about 60° — the angle between printed numbers on the periphery of wheel 86.

In a manner similar to that of inner and outer minutes display wheels 80 and 82, inner and outer hours display wheels 86 and 88 present printed numbers on their peripheries for viewing through viewing window $W_1$. During the dwell of hours display wheel 88, window 96 on the periphery of wheel 88, aligns with viewing window $W_1$ in front plate 27 so that printed numbers displayed on the periphery of inner wheel 86 can be viewed through the window. During the dwell, inner wheel 86 incrementally advances to display printed numbers 1, 2, 3, 4, 5, and 6 consecutively. Upon advancing from 6 to 1, outer wheel 88 advances to display the printed number 7 on its periphery through viewing window 96. Although the inner wheel 86 has advanced so that the printed number 1 aligns with window $W_1$, it cannot be viewed now that window 96 has rotated out of alignment with window $W_1$. On the next advance, outer wheel 88 moves to display number 8 through window $W_1$ and inner wheel 86 advances to align the number 2 with window $W_1$ although number 2 is still hidden from view by wheel 88. In the same manner of the next advance, outer wheel 88 displays 9 while inner wheel 86 advances to its 3 position (still hidden). On the next advance, outer wheel 88 displays 10 as inner wheel 86 advances to its 4 position (still hidden). On the subsequent advance, outer wheel 88 displays 11 as inner wheel 86 advances to its b 5 position (still hidden). On the next advance, outer wheel 88 displays 12 as inner wheel 86 advances to its 6 position (still hidden). Starting the cycle over again on the next advance, outer wheel 88 advances so that its window 96 is again aligned with window $W_1$, and at the same time, the number 1 on inner wheel 86 advances into view through windows 96 and $W_1$. The cycle described above repeats itself every 12 advances of inner hours display wheel 86.

What is claimed is:

1. In a display mechanism of the type wherein rotatable display means carry indicia on their periphery, the improvement comprising providing:

a. a first rotatable display means having at least one window in its periphery and indicia spaced about said periphery, b. a second rotatable display means rotatable within said first rotatable display means and having indicia spaced about its outer periphery to be individually exposed to said window, and c. intermittent advance means whereby at least one of said first and second rotatable display means is incrementally advanced comprising:

1. a cam member having a ramped surface ramped in a direction of said cam member's axis of rotation and a ramped surface ramped radially from said axis,
2. a drive lever responsive to said ramped surfaces, and
3. actuator means responsive to said drive lever and coupled to said one rotatable display means.

2. In a digital display means according to claim 1 further including a synchronizing means coupled between said first and second rotatable display means and synchronizing the rotation of said first and second rotatable display means with respect to each other.

3. In a display mechanism according to claim 1 wherein said actuator means includes a ratchet profile engaged by said drive lever, a gear coupled to said ratchet profile, and a pinion engaging said gear and coupled to said one rotatable display means.

4. In a display mechanism according to claim 2 wherein said synchronizing means includes a locking ring having at least two projections extending therefrom providing a notch therebetween, and a gear having an even number of teeth, the face width of every other one of said teeth being shorter than the remaining teeth all of said teeth engaging said notch, and half of said teeth engaging a periphery of said ring.

* * * * *

UNITED STATES PATENT AND TRADEMARK OFFICE

CERTIFICATE OF CORRECTION

PATENT NO. : 4,022,376

DATED : May 10, 1977

INVENTOR(S) : Richard H. Weber

It is certified that error appears in the above-identified patent and that said Letters Patent are hereby corrected as shown below:

Column 1, line 7 delete "idicia" and insert ---indicia---.
Column 1, line 23 & 24 delete "application" and insert ---applications---.
Column 2, line 9 insert ---comprises--- after "generally".
Column 2, line 19 delete "46" and insert ---48---.
Column 3, line 36 delete "wheels" and insert ---wheel---.
Column 3, line 51 & 52 all numbers should be in " ".
Column 3, line 58 all numbers after word "numbers" should be in " ".
Column 3, line 63 all numbers should be in " ".
Column 3, line 68 numbers 9 and 5 should be in " ".
Column 4, line 3, numbers 5,6,7,8, and 9 should be in " ".
Column 4, lines 12 & 13 numbers 0,1,2,3,4, and 5 should be in " ".
Column 4, line 21, numbers 1,2,3,4,5, and 6 should be in " ".
Column 4, line 22, delete "the" and insert ---The---.
Column 4, line 25, numbers 7,8,9,10,11, and 12 should be in " ".
Column 4, line 31, numbers 7 and 12 should be in " ".
Column 4, line 34 numbers 7,8,9,10,11, and 12 should be in " ".
Column 6, line 14, delete "remainig" and insert ---remaining---.
Column 6, line 45 delete "advance" and insert ---advances---.
Column 7, line 9 delete "advane" and insert ---advance---.
Column 7, line 48 delete "Dirve" and insert ---Drive---.
Column 7, line 58 delete ";" after "takes".
Column 8, line 15, numbers 0,1,2,3, and 4 should be in " ".

UNITED STATES PATENT AND TRADEMARK OFFICE

CERTIFICATE OF CORRECTION

PATENT NO. : 4,022,376

DATED : May 10, 1977

INVENTOR(S) : Richard H. Weber

It is certified that error appears in the above-identified patent and that said Letters Patent are hereby corrected as shown below:

Column 8, line 16, numbers 4 and 0 should be in " ".
Column 8, line 17, number 5 should be in " ".
Column 8, line 19, number 0 should be in " ".
Column 8, line 23, number 6 should be in " ".
Column 8, line 24, number 1 should be in " ".
Column 8, line 28 number 2 should be in " ".
Column 8, line 30, number 3 should be in " ".
Column 8, line 32 number 9 should be in " ".
Column 8, line 33 number 4 should be in " ".
Column 8, line 37, number 0 should be in " ".
Column 8, line 42, number 9 should be in " ".
Column 8, line 43 number 0 should be in " ".
Column 8, line 53 number 5 should be in " ".
Column 8, line 54 number 0 should be in " ".
Column 8, line 56 number 5 should be in " ".
Column 8, line 56 number 0 should be in " ".
Column 9, line 10, number 5 should be in " ".
Column 9, line 11, number 0 should be in " ".
Column 9, line 13, number 5 should be in " ".
Column 9, line 14, number 0 should be in " ".
Column 9, line 20, numbers 5 & 0 should be in " ".
Column 9, line 34, numbers 1,2,3,4,5, and 6 should be in " ".
Column 9, line 35, numbers 6 & 1 should be in " ".
Column 9, line 36, number 7 should be in " ".

UNITED STATES PATENT AND TRADEMARK OFFICE

CERTIFICATE OF CORRECTION

PATENT NO. : 4,022,376

DATED : May 10, 1977

INVENTOR(S) : Richard H. Weber

It is certified that error appears in the above-identified patent and that said Letters Patent are hereby corrected as shown below:

Column 9, line 38, number 1 should be in " ".
Column 9, line 41, number 8 should be in " ".
Column 9, line 43, numbers 2 & 2 should be in " ".
Column 9, line 45, number 9 should be in " ".
Column 9, line 46, number 3 should be in " ".
Column 9, line 47, number 10 should be in " ".
Column 9, line 48, number 4 should be in " ".
Column 9, line 49, number 11 should be in " ".
Column 9, line 50, number 5 should be in " ".
Column 10, line 1, number 12 should be in " ".
Column 10, line 2, number 6 should be in " ".
Column 10, line 6 number 1 should be in " ".

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*